United States Patent [19]

Taylor

[11] 4,061,306

[45] Dec. 6, 1977

[54] DECORATION PLATFORM ASSEMBLY

[76] Inventor: Robert T. Taylor, 1693 Perrysville Ave., Pittsburgh, Pa. 15212

[21] Appl. No.: 743,709

[22] Filed: Nov. 22, 1976

[51] Int. Cl.[2] ..... A47G 33/12

[52] U.S. Cl. ..... 248/523; 47/40.5; 428/7

[58] Field of Search ..... 74/96; 248/524, 523; 269/287; 240/10 Q; 428/12, 13, 15, 17-20; 211/1.5

[56] References Cited

U.S. PATENT DOCUMENTS

| | | | |
|---|---|---|---|
| 763,856 | 6/1904 | Chenot | 248/524 |
| 1,155,383 | 10/1915 | Tischer | 248/523 X |
| 1,742,212 | 1/1930 | Muldoon | 428/7 X |
| 2,023,340 | 12/1935 | Peskulich | 248/524 |
| 2,190,544 | 2/1940 | Jarnagin | 428/256 X |
| 2,260,932 | 10/1941 | Chulick et al. | 248/524 |
| 2,344,639 | 3/1944 | Ressinger | 428/7 X |
| 2,913,202 | 11/1959 | Meldrum | 47/40.5 |
| 3,026,075 | 3/1962 | Phelon et al. | 248/529 X |
| 3,411,740 | 11/1968 | Schulz | 248/529 X |
| 3,526,379 | 9/1970 | Schwaderlapp | 248/527 X |
| 3,715,095 | 2/1973 | Drablowski | 248/527 X |

*Primary Examiner*—George F. Lesmes
*Assistant Examiner*—Henry F. Epstein
*Attorney, Agent, or Firm*—Paul Bogdon

[57] ABSTRACT

An ornamental decoration assembly such as would be used with a Christmas tree is disclosed. The assembly provides a decorative effect with the tree while supporting the tree in place. The assembly includes a base having an ornamental decoration on its upper surface with its bottom surface being constructed to stably rest on a floor, table, or other flat surface. A socket is arranged within the ornamental decoration for receiving the lower portion of the tree's stem, Included within the socket is a tubular member, a guide for positioning the tree so that it is straight, and a flexible loop through which the stem is placed. The loop is attached to a flexible shaft which is connected to the drive shaft of a gear which is driven by a worm. The worm is actuated by a stem which extends upwardly to a point above the decoration surface. By turning the stem the loop may be retracted around the tree stem to lock the tree in fixed position in the socket.

6 Claims, 3 Drawing Figures

DECORATION PLATFORM ASSEMBLY

BACKGROUND OF THE INVENTION

This invention relates to an ornamental decoration assembly, and particularly to one which would be placed on the floor or table beneath a Christmas tree, and more particularly to an assembly which will support a Christmas tree in place and at the same time have a decorative display appropriate to the Christmas season.

Various designs of support stands for Christmas trees are well known. Most are cumbersome devices that require a large base to provide the needed support stability for holding the tree in place. That is especially true for stands made to hold live trees. Artificial Christmas trees usually are provided with a support arrangement secured in some fashion to the bottom of the tree's stem. None of the tree support arrangements is compatible with decorative seasonal displays placed under the tree. Such displays must be arranged around the oftentimes large and cumbersome support stands and thus the stands detract from the effect sought from the display. There is also a need for having permanent decorative displays to be placed under a tree. Retail establishments would particularly find that desireable. However, large scale production of such decorative displays would be economically impracticable because of the wide variety of support stands which would have to be taken into consideration in designing the display.

An ornamental decoration assembly which provides support to a standing Christmas tree is desireable because it avoids having to use an awkward support stand while at the same time permitting an attractive permanent display which is not marred in its effect by the presence of a stand. This invention is directed to such an assembly which has those favorable characteristics. In addition the assembly of this invention avoids the need for putting together a display which is time consuming and oftentimes frustrating. The decorative portion of the display of this invention may, however, be designed to allow the user to add features to it so that the user is not denied his own creativity and variety. Also, this invention requires only that the bottom portion of the stem of the tree be inserted into the socket provided and the simple hand manipulation of an actuator for securing the tree in place. Thus, this invention avoids the other drawback of existing support stands of having to screw in three or four bolts while lying on the floor in a contorted position.

SUMMARY OF THE INVENTION

The present invention provides an ornamental decoration assembly which, in its preferred form, includes a base member having a seasonal ornamental decoration, such as snow covered mountains, a scenic village, pine trees, lights, and the like, on its upper surface with its bottom surface constructed to stably rest on a flat surface such as a floor, table, or the like; socket means for receiving and securing a stem of a Christmas tree or the like; the socket means including a tubular member, guide means for positioning the stem generally centrally of the tubular member, and locking means for engaging the stem and locking it in fixed relationship with the tubular member; and actuator means having at least a portion thereof disposed externally of the ornamental decoration and operative with the locking means for selectively actuating the locking means between locked and unlocked positions. The invention may also include a force multiplying means, such as a worm-gear assembly, as part of the locking means whereby the user would not need to expend a great deal of energy in securing the tree in place. The guide insures that the tree is properly centered in the socket and when it is the user simply manipulates the actuator to cause the tree to be locked in place. The outer shell of the socket could be in the form of a mountain, for example, and the tube, guide, and locking means may be interconnected as a single unit which would be simply inserted into the socket shell and held in place by screwing the tubes to a removable plate on the bottom of the base member. Various designs are contemplated for the elements which could engage and hold the tree in place. The holder could be an expandible and and retractable loop which may be drawn tightly around the stem of the tree; or it could be a reciprocable plunger which moves transversely of the tube and in effect urges the stem against the sides of the tubes; or it may be a flexible ring member which may be squeezed around the stem to grip it tightly. Also, a gear train or a light motor could be used as the force multiplier, either of which could be easily actuated from a position outside the decoration. Various other modifications, details and advantages of this invention will become apparent as the following description of a certain present preferred embodiment thereof proceeds.

DESCRIPTION OF THE DRAWINGS

In the accompanying drawings I have shown a present preferred embodiment of the present invention in which.

Figure 1:
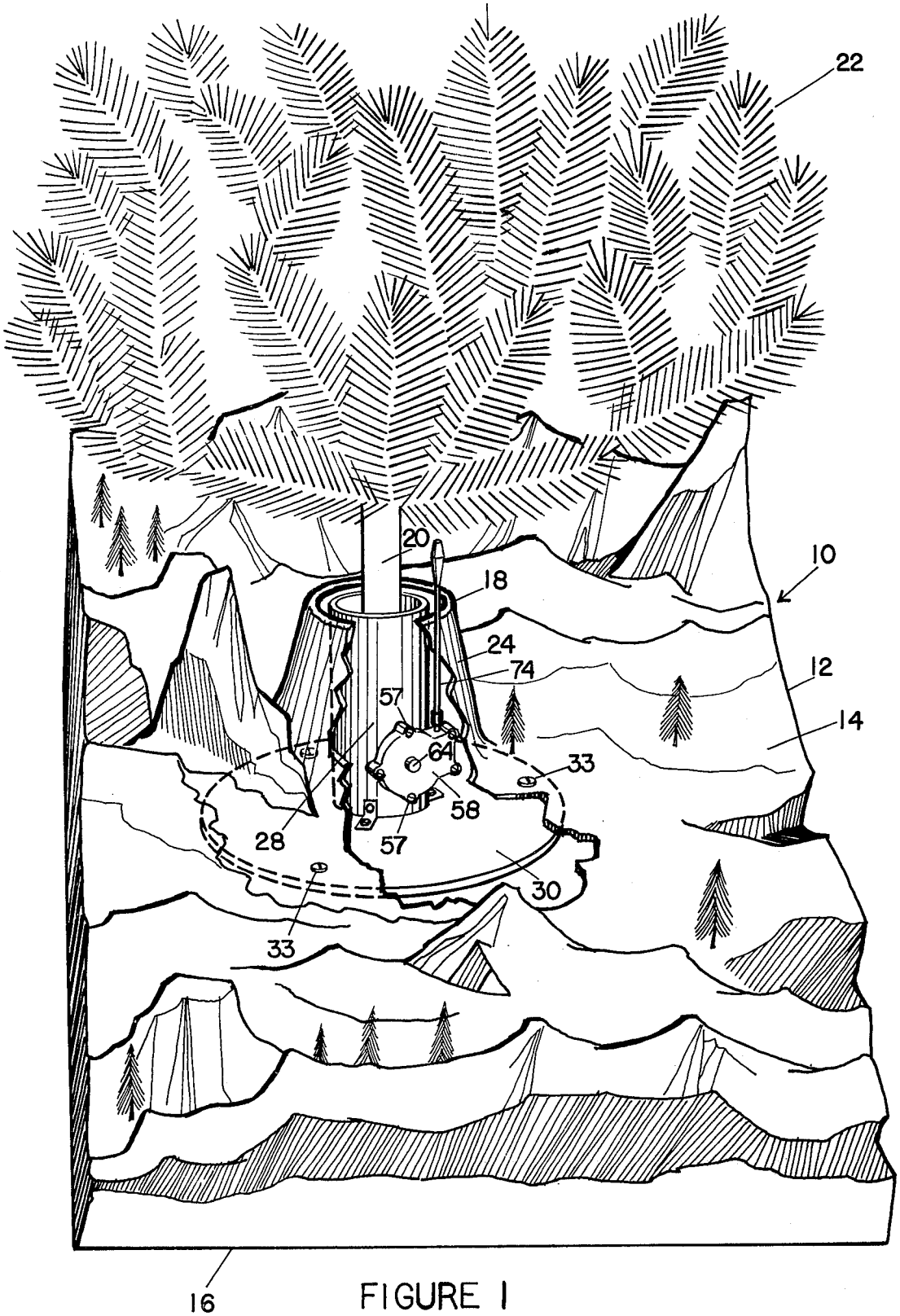
FIG. 1 is a partial perspective view of the ornamental decoration assembly of the present invention with parts cut away to show details of construction.

Referring now to the drawings, there is shown an ornamental assembly embodying one form of the present invention and generally designated by the numeral 10. Decoration assembly 10 includes a base member 12 molded from a suitable plastic material having an upper surface 14 of a decorative seasonal design. The upper surface 14 may include snow capped mountains, pine trees, a frozen lake, lights, figures of people, and the like. The decorative design shown is strictly illustrative of many designs which could be made. The base member 12 has a flat lower edge or bottom surface 16 which permits the entire assembly to rest stably on a flat surface such as a floor or table. Generally centrally located on the base member 12 is a socket 18 for receiving the stem 20 of the Christmas tree 22. The socket 18 includes an outer shell 24 formed integrally with the upper surface 14 of the base member 12. Outer shell 24 is shown in the form of a mountain which is consistent with the overall design of the upper surface 14. The socket 18 serves to receive and secure the lower portion of the stem 20 of the tree 22 thereby holding the tree in place with respect to the base member 12. The socket 18 also includes a cylindrically shaped tubular member 28 which is secured to a plate 30 by means of screws 32.

The plate 30, in turn, is secured to the base member 12 by screws 33. The tubular member 28 is sized to be detached from the base member 12 and is simply separated by removing the screws 33 and withdrawing the plate 30 and tubular member from the base member.

Figure 2:
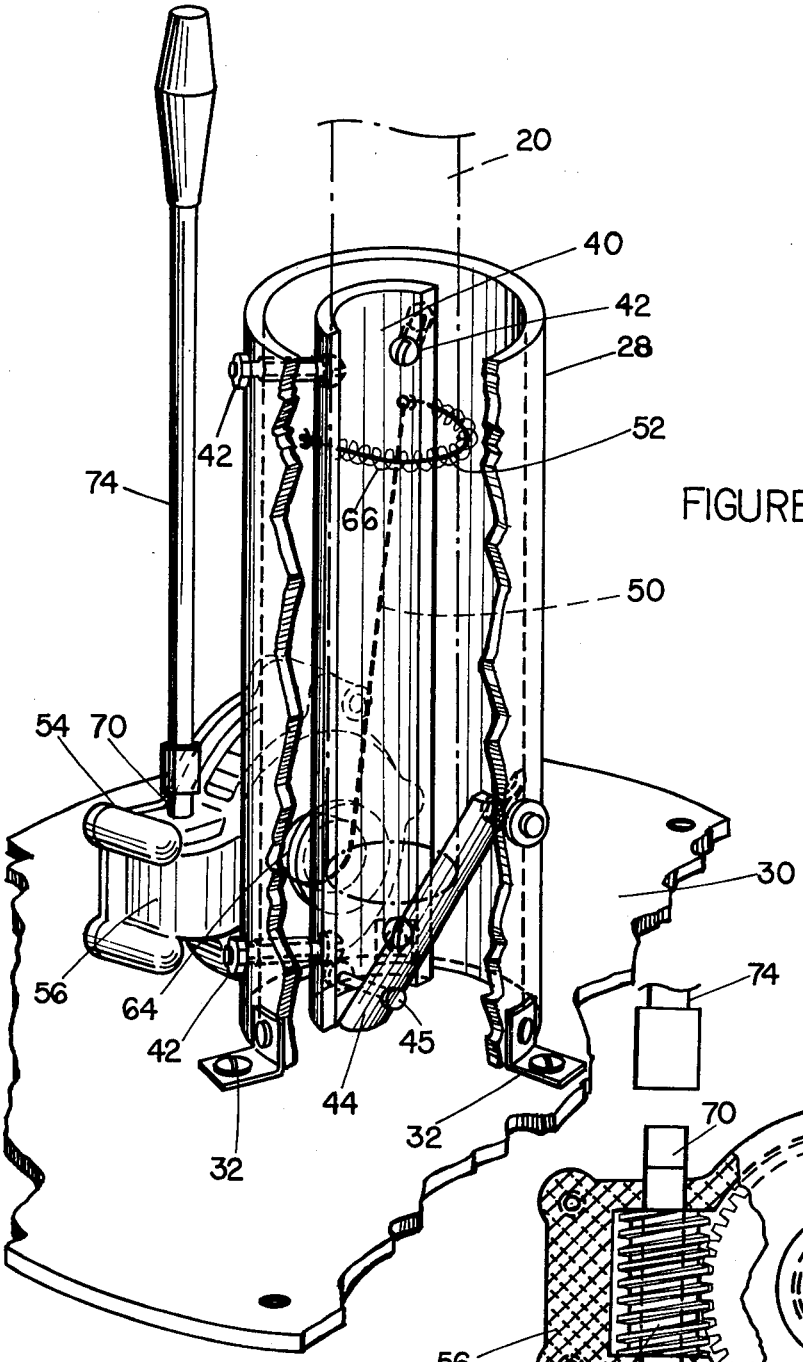
FIG. 2 is a perspective view of the tree holding portion of the socket means of the assembly of the present invention with parts broken away to show details of construction.

As is clearly shown in FIG. 2, disposed within the tubular member 28 is a guide means for positioning the stem 20 generally centrally of the tubular member and in a vertical position. The guide means includes trough shaped first guide piece 40 which, as shown, is a section of a cylinder, secured in parallel relation with the tubular member by removable nut and bolt assemblies 42. The first guide piece 40 extends over a major portion of the length of the tubular member 28. A second guide piece 44 is disposed within tubular member 28 at the lower portion thereof laterally at an oblique angle to the longitudanl axis of the tubular member. The lower end of the second guide piece 44 abuts the lower end of the first guide piece 40, and is secured to the tubular member 28 by rivet 45, nut and bolt assemblies, or the like. Thus, when stem 20 is inserted into tubular member 28, it will strike the second guide piece 44, and be guided into snug relationship with the first guide piece 40 and thereby become vertically oriented in a parallel relationship with the tubular member.

Figure 3:
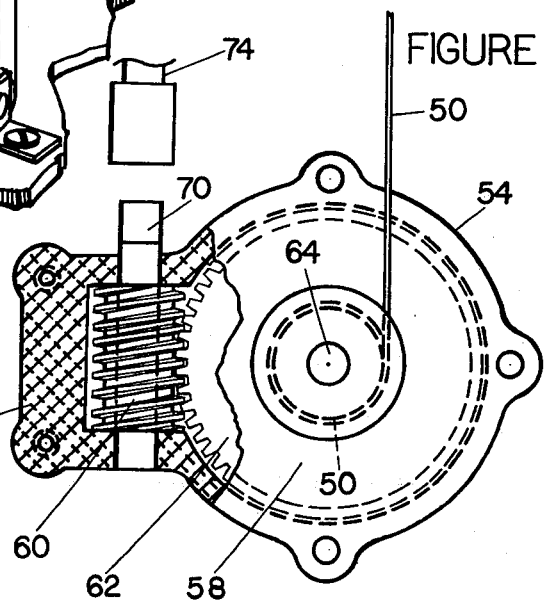
FIG. 3 is a front elevation view of the worm-gear assembly forming part of the assembly of FIGS. 1 and 2, with a section broken away to show details of construction.

Locking means for engaging the stem 20 and locking it in fixed relationship within the socket 18 are provided within the socket. The locking means includes a flexible cable member 50 having one end fixed to an upper portion of the first guide piece 40. A loop 52 is formed in the cable member 50 and the cable in turn passed through an opening in the first guide piece 40 and downwardly in the space between the first guide piece and the tubular member 28 to a power assembly 54. The power assembly 54, as clearly shown in FIG. 3, is a worm-gear drive system including a housing 56 fixed by screws 57 to a lower outer portion of tubular member 28 with a removable cover 58, a drive worm-gear 60 suitably arranged for rotation in the housing, and a driven gear 62 which meshes with worm 60 and also suitably supported by the housing for rotation therein. A shaft 64 is fixed to gear 62 and extends outwardly of housing 56 and into the confines of the space provided between first guide piece 40 and tubular member 28. The lower end of the cable member 50 is secured to the shaft 64. Screws 57 serve to secure the cover 58 on the main section of housing 56 as well as to secure the entire power assembly 54 to the tubular member 28. A helical coil spring 66 surrounds the loop 52 of the cable member 50 with the opposite ends thereof abutting the first guide piece 40. The spring 66 serves to hold the shape of loop 52 and to return the loop to its shape whenever any locking force is removed from the spring.

A key post 70 is fixed to worm 60 and is open to the outside of housing 56. The key post 70 faces upwardly of the base member 12 and is aligned with an opening through the upper surface 14 of the base member. An actuator in the form of a key shaft 74 is provided for insertion onto or off of the key post 70 whereby imparting a rotational force to the key shaft 74 results in that force being transmitted to rotate worm 60 and gear 62. Gear 62 in turn will cause shaft 64 to rotate and wrap or unwrap the cable member 50. Thus, the stem 20 of tree 22 is inserted into the socket 18 so that the stem passes through the loop 52 and is vertically oriented by coacting with first and second guide pieces 40 and 44, and the key shaft 74 rotated in the direction to wind the cable member 50 about shaft 64 and in so doing drawing on the cable to retract loop 52 until the stem is secured against the first guide piece 40. The inherent design of the worm 60-gear 62 will maintain the loop 52 in a locked relationship to the stem 22, since a force of high magnitude would be required to rotate the gear 62 against the worm 60 for unwinding the cable member 50. In other words, because of the mechanical advantage nature between a worm and driven gear the force required to turn the gear is very small as compared to a reverse force imparted at the output of the driven gear to drive the worm. The tree 22 is easily removed by applying a reverse direction force to key shaft 74 to unwind the cable member 50 and unloosen the loop 52 thereby unlocking the stem 20. When the tree 22 is locked in place the key shaft 74 may be removed from the key post 70. In so doing there would be nothing on the upper surface 14 of the base member 12 but the decorative design.

The particular features of this invention may take on various mechanical configurations as those skilled in this art would readily recognize. Instead of a worm-gear force multiplying assembly a spur-gear train could be used which would be also actuated by a key shaft extending exteriorly of the base member. Similarly a low horsepower electric motor could be substituted for the gear assembly as could a large cylindrical screw arranged to rotate within the tubular member. Thus, any variety of force multiplying means could be used in cooperation with the locking means for securing the tree in place.

Various forms of tree locking means are also contemplated within the scope of this invention. Instead of a retractable and expandible loop form and a cable member design, a reciprocable plunger could be used which would be oriented to translate transversely to the tubular member of the socket to engage the stem of the tree and urge it in a locked position against the tubular member. Also, a donut shaped flexible ring could be arranged with the tubular member through which the stem of the tree would be positioned. A cylindrical screw, mentioned above, would be arranged to rotate within the tubular member to engage the donut ring to squeeze the ring into a securing relationship with the stem of the tree.

Similarly to the above noted variations of structual forms of the locking and actuating means, the guide means for vertically orienting the tree are available. For example a frusto-conically cup could be fixed centrally of the lower section of the tubular member and the stem of the tree guided into the cup whereby the tree would then be vertically orientated. Also, the base member may be provided with extension pieces which could be extended or retracted so that if a large overall base would be desirable the extension pieces could be extended.

It should now be clearly understood how the advantages of the present invention as set forth in this introductory portion of this specification are achieved. The beauty and integrity of the decorative display is maintained because there are no cumbersome and bulky interferring tree support stands, the tree support being hidden and a part of the overall assembly.

While I have shown and described a present preferred embodiment of this invention it is to be distinctly understood that the invention is not limited thereto, but may be otherwise variously embodied within the scope of the following claims.

I claim:

1. An ornamental decoration platform assembly, comprising base member means having an ornamental decoration on its upper surface and having its bottom surface constructed to stably rest on a flat surface;

socket means for receiving and securing a stem member, the outer surface of said socket means forming part of said upper surface of said base member;

said socket means including within its confines a tubular member guide means for positioning a stem member generally centrally of said tubular member, retractable and expandable locking means constructed and arranged to surround a stem member for engaging and locking it in fixed relationship with said tubular member; and actuator means operative with said locking means for selectively actuating said locking means between locked and unlocked positions, said actuator means having at least a portion thereof disposed externally of said ornamental decoration and constructed and arranged for being operatively manipulated at a position above the surface of said ornamental decoration.

2. An ornamental decoration assembly as set forth in claim 1 wherein said locking means includes force multiplying means.

3. An ornamental decoration assembly as set forth in claim 2 wherein said locking means is a loop member sized to surround a portion of a stem member, and including a flexible cable and shaft means connecting said loop member and said force multiplying means for imparting and releasing a locking force to and from the loop member.

4. An ornamental decoration assembly as set forth in claim 1 wherein said locking means includes gear train means for multiplying and transmitting force for locking a stem member in place.

5. An ornamental decoration assembly as set forth in claim 1 wherein said guide means and locking means are secured to said tubular member, and wherein said tubular member is removable from said base member means.

6. An ornamental decoration assembly as set forth in claim 1 wherein said actuating means is an elongated rod member having a gripping upper portion disposed externally of said ornamental decoration.

* * * * *